US011697913B2

(12) United States Patent
Horner

(10) Patent No.: US 11,697,913 B2
(45) Date of Patent: Jul. 11, 2023

(54) WATER FLOW CONTROL DEVICE

(71) Applicant: Robert L. Horner, Charleston, SC (US)

(72) Inventor: Robert L. Horner, Charleston, SC (US)

( * ) Notice: Subject to any disclaimer, the term of this patent is extended or adjusted under 35 U.S.C. 154(b) by 53 days.

(21) Appl. No.: 17/572,005

(22) Filed: Jan. 10, 2022

(65) Prior Publication Data

US 2022/0220684 A1 Jul. 14, 2022

Related U.S. Application Data

(60) Provisional application No. 63/134,999, filed on Jan. 8, 2021.

(51) Int. Cl.
*E02B 3/10* (2006.01)
*E02B 7/50* (2006.01)

(52) U.S. Cl.
CPC ..... *E02B 7/50* (2013.01); *E02B 3/102* (2013.01)

(58) Field of Classification Search
CPC ... E02B 3/102; E02B 7/26; E02B 7/50; F16K 21/18; F16K 31/18; F16K 33/00
See application file for complete search history.

(56) References Cited

U.S. PATENT DOCUMENTS 3,070,963 A * 1/1963 Dubouchet ..... E02B 7/26 137/286
3,789,865 A * 2/1974 Borman ..... G05D 9/02 137/413
5,106,494 A * 4/1992 Norcross ..... B01D 21/2444 210/123
5,313,977 A * 5/1994 Bergsma ..... F16K 17/363 137/202
5,421,995 A * 6/1995 Norcross ..... C02F 3/006 210/94
5,762,090 A * 6/1998 Halamish ..... F16K 24/044 137/202
10,254,728 B2 * 4/2019 Hill ..... A01G 25/167
11,112,011 B1 * 9/2021 Murphy ..... F16K 1/2007
11,255,100 B1 * 2/2022 Hughes ..... E04H 9/145
2011/0110722 A1 * 5/2011 van den Noort ..... E02B 3/104 405/87
2014/0191145 A1 * 7/2014 Aughton ..... F16L 55/1018 74/89.2
2019/0040967 A1 * 2/2019 Bright ..... F16K 31/18
2019/0194894 A1 * 6/2019 Terata ..... E02B 7/50
2020/0408328 A1 * 12/2020 Schwarzbek ..... F16K 31/46

* cited by examiner

*Primary Examiner* — Benjamin F Fiorello
(74) *Attorney, Agent, or Firm* — Haynsworth Sinkler Boyd, P.A.

(57) ABSTRACT

A water flow control device is provided that opens to allow water to leave a basin and pour into another pool of water. The water flow control device closes when the level in the pool of water is such that an influx of water could be returned to the basin. The water flow control device has a buoyancy apparatus that opens and closes the water flow control device based upon the level in the pool of water. The water flow control device also has a conveyance channel apparatus that directs water from the basin through the water flow control device in the event the buoyancy apparatus provides an opening to do so.

20 Claims, 4 Drawing Sheets

WATER FLOW CONTROL DEVICE

CROSS-REFERENCE TO RELATED APPLICATIONS

This application claims priority to U.S. Provisional Application No. 63/134,999, filed on Jan. 8, 2021, which is incorporated herein by reference in its entirety.

FIELD OF INVENTION

The present invention provides a water flow control device that allows for the outfall or removal of water from a body of water, but prevents the backflow of undesirable floodwaters or potentially contaminated water from storm or tidal surges, for example. The invention also provides a method for controlling the outflow from a body of water while preventing the inflow of undesirable water into the body.

BACKGROUND

A flow control device, as further disclosed herein, is intended to control the rate of flow of fluids from a body of water, for example, a freshwater retention basin, reservoir, pond, lake, stream, river and wetland. A flow control device can control the rate of water removal from such a body of water to maintain a certain water level in the body of water. Such bodies of water may be an intake for rainwater or ground water runoff from higher elevations to control the movement of water in a certain area. Such bodies may serve as detainment systems, for example, which are commonly used to control the rate at which rainwater drains from a developed property.

It is desired to maintain the characteristics including the elevation of the water by preventing the entry of water into the body that would otherwise compromise the freshwater characteristics of the water and that may also cause flooding. One exemplary source of contamination is salt water when these freshwater bodies are located proximate to an ocean. Tidal surges may be caused by strong winds from a cyclone, tropical storm or hurricane. During high tide, additional heavy rainfall being directed to the ocean or other outfall as a result of more water being pushed into the sea in combination with heavy winds can increase the amount of water that surges inland that may otherwise then be directed to these nearby water bodies.

In some instances, drains are sized and positionally located to control the rate of water removal from these water basins. Other conventional flow control devices may also be deployed to better control the movement of water from the holding area depending upon the amount of freshwater being received by the basin. At an additional cost, pumps may also be installed to control the flowrate of water removed from the basin. However, these conventional flow control devices have not been designed to prevent the backflow entry of less desirable water into the basin.

It would be desirable to provide a reliable system for controlling the rate of discharge of a water from a basin that permits fluid discharge rates that can be somewhat independent of the fluid level in the basin, and permits a wide range of flow rates to be achieved but yet that prevents the backflow of water into the basin.

There is a long-felt need for a water flow control device, in particular, that allows a desired outflow from the water reservoir or pond, for instance, but prevents the entry of a contaminating inflow or the introduction of undesired volume from entering the water body. As an example, such an inflow that is to be prevented may be the result of a tidal surge that would otherwise allow salt water to be introduced into the freshwater retention basin, reservoir, pond, lake, stream, river and wetland or otherwise impounded area or drainage system.

There remains a need in the art for a water flow control device that allows outflow from a body of water but prevents the undesirable entry of an undesirable inflow to the water body.

SUMMARY OF INVENTION

The present invention relates to a water flow control device that allows the outflow of water from a basin but prevents the entry of otherwise undesirable water into the water body or system. Without intending to be bound by theory, the water flow control device of the invention offers the ability to control a desired flow out of a water or system basin but improves protection from undesirable, contaminating or soiled waters from entering the water basin or system or other upstream area.

An aspect of the invention provides a water flow control device comprising a floor, a plurality of channels or other structural support at a top of the floor, a buoyancy apparatus that determines an open or a closed position of the water flow control device, and a conveyance channel apparatus through which water may be removed based on the position of the water flow control device. In an embodiment of the invention, the buoyancy apparatus includes a flotation device affixed to a bottom of the floor. Further pursuant to this embodiment of the invention, the flotation device may have a multiplicity of interstitial spaces to assist with the control of the functionality of the buoyancy apparatus. In yet another embodiment of the invention, the flotation device is substantially closed cell.

In an embodiment of the invention, the water flow control device of the invention may additionally include a gasket substantially configured about a circumferential perimeter of a bottom of the floor. Further pursuant to this embodiment of the invention, the gasket is constructed of a medium or firm density rubber foam. In certain embodiments of the invention, the gasket comprises a buoyant cell and a polymer sheath substantially encloses the buoyant cell. In certain other embodiments of the invention the polymer sheath is a high density polyethylene (HDPE). Further pursuant to this embodiment of the invention, the bottom of the floor includes a buoyant cell and the polymer sheath, preferably constructed of a HDPE, encloses the buoyant cell.

In an embodiment of the invention, the buoyancy apparatus of the water flow control device forms an opening to allow the removal of water through a channel of the conveyance channel apparatus. In another embodiment of the invention, the buoyancy apparatus closes the opening to prevent the influx of water into the channel of the conveyance channel apparatus.

In certain embodiments of the invention, the water flow control device also has one or more legs to assist with support of the water flow control device in the conveyance channel apparatus. A water flow control device having one or more legs are substantially flush with an inside edge of the gasket, according to an embodiment of the invention.

In an embodiment of the invention, the conveyance channel apparatus of the water flow control device comprises a top surface upon which the gasket becomes engaged to close off an opening between the water flow control device and the conveyance channel apparatus. In certain embodiments of the invention, the conveyance channel apparatus has four sides and a geometric shape that is substantially square. In yet other embodiments of the invention, the conveyance channel apparatus is substantially constructed of concrete.

In another aspect of the invention, the invention provides a method for controlling the outflow of water from a basin and preventing an influx of water to the basin including the steps of providing a water flow control device having a buoyancy apparatus and a conveyance channel apparatus; sensing through the use of the buoyancy apparatus when water may safely be removed through the conveyance channel apparatus; creating an opening using the buoyancy apparatus to allow the removal of water through the conveyance channel apparatus; sensing through the use of the buoyancy apparatus when water may not safely be removed through the conveyance channel apparatus; and closing the opening using the buoyancy apparatus to prevent the influx of water into the conveyance channel apparatus.

Further pursuant to this aspect of the invention, the buoyancy apparatus allows an opening to be formed between a floor of the water flow control device and a top surface of the conveyance channel apparatus. In the embodiment where a gasket substantially surrounds a bottom perimeter of the floor, the buoyancy apparatus allows the gasket to contact the top surface of the conveyance channel apparatus to close the opening that had been formed.

Other aspects and embodiments will become apparent upon review of the following description taken in conjunction with the accompanying drawings. The invention, though, is pointed out with particularity by the included claims.

BRIEF DESCRIPTION OF THE DRAWINGS

Figure 1:
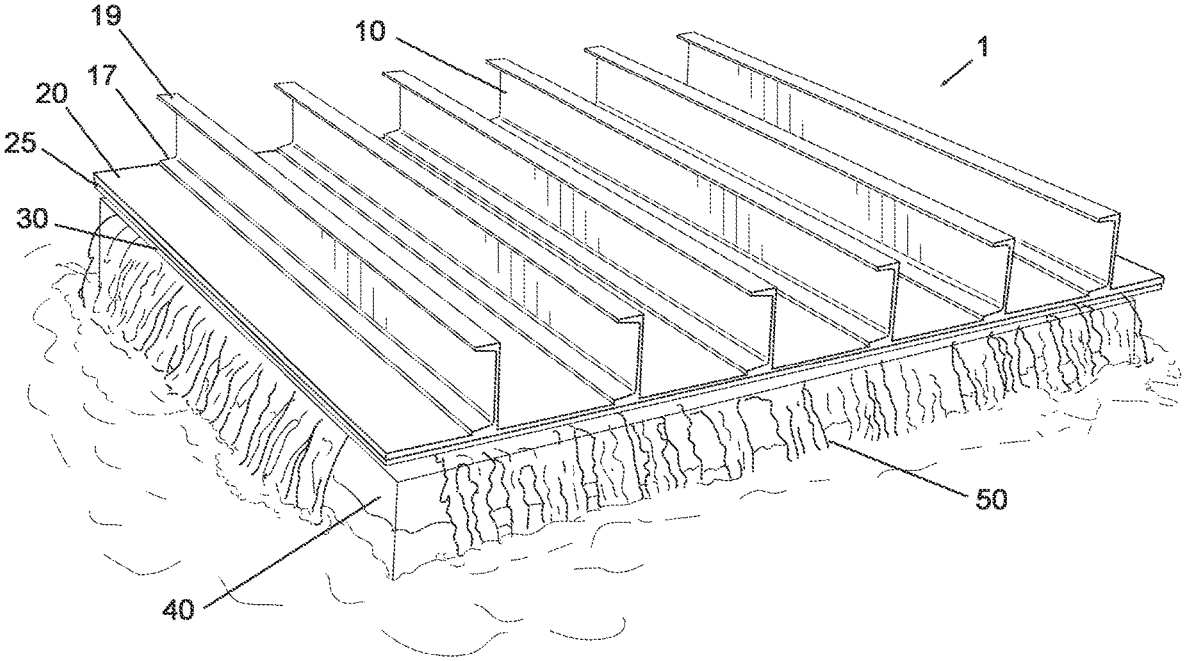
Figure 3:
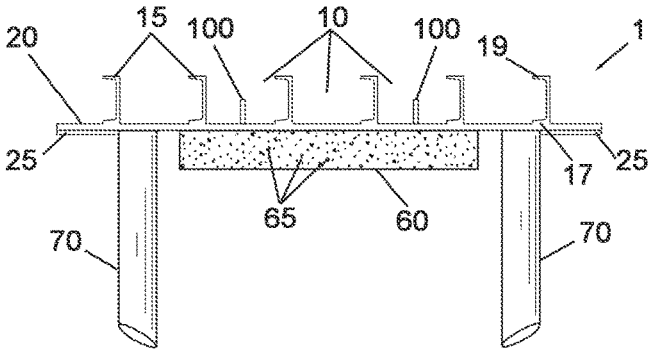
Figure 2:
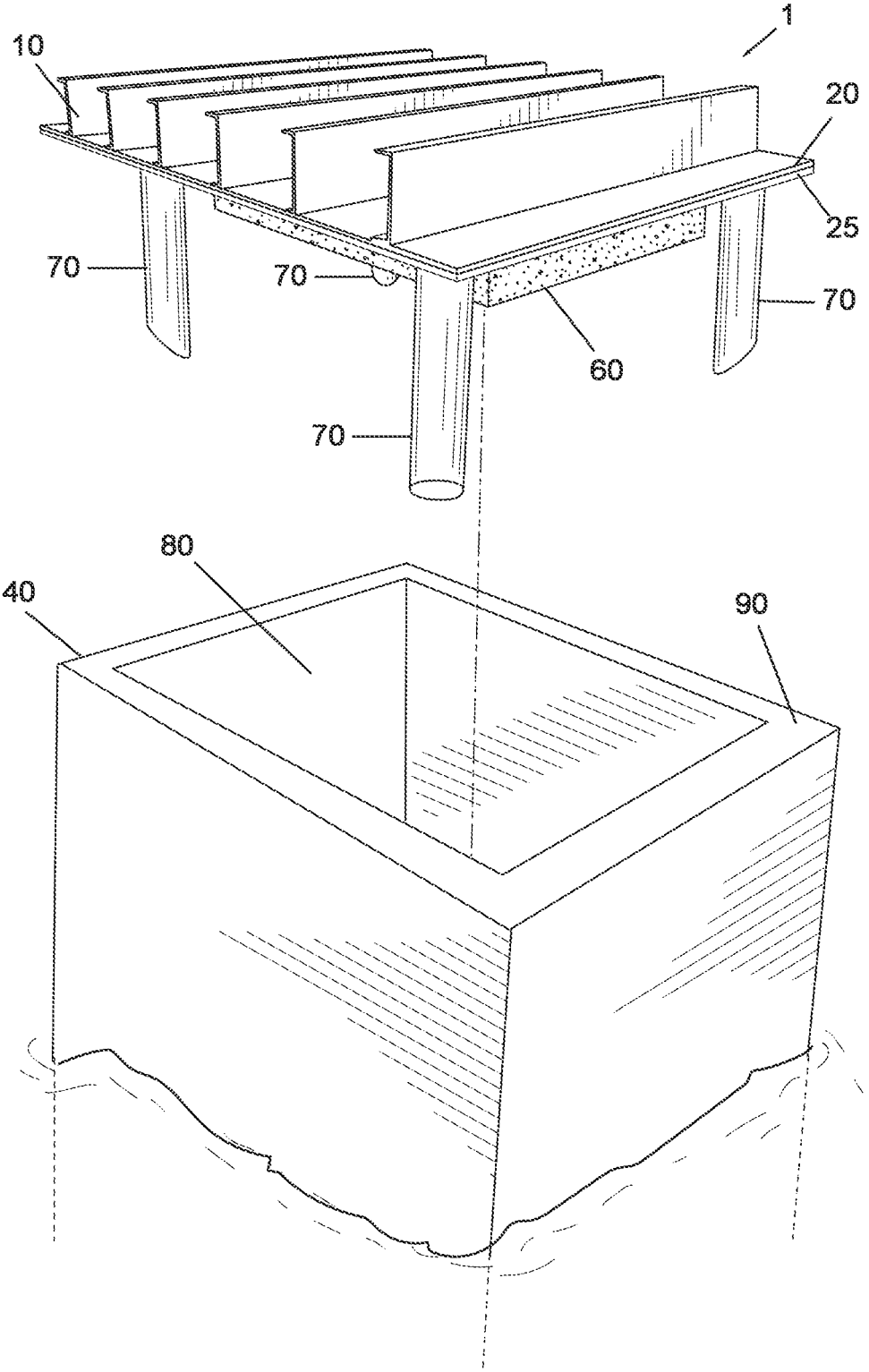
Figure 4:
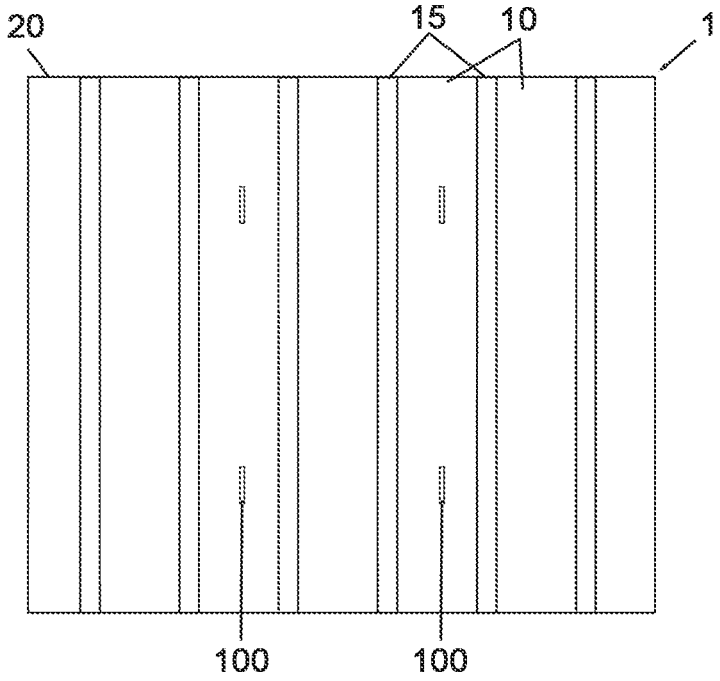
Figure 5:
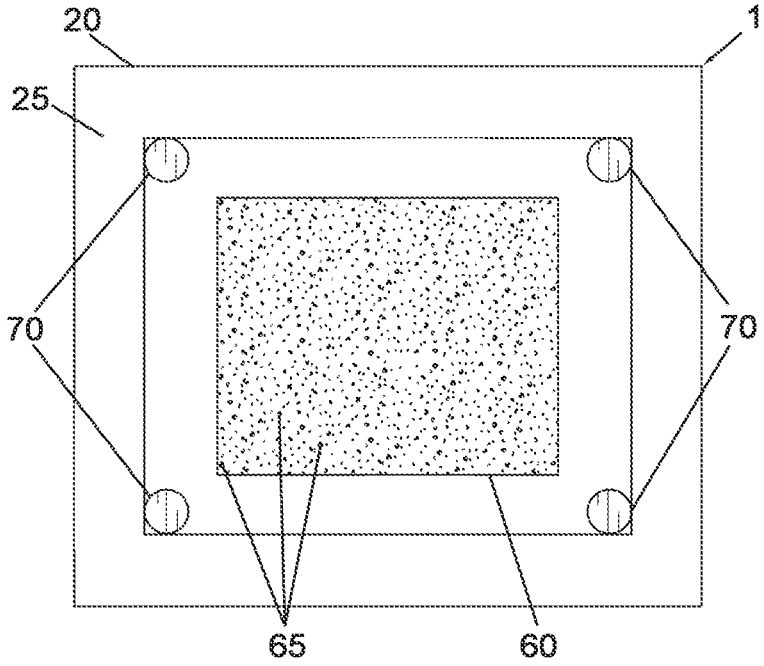
Figure 6:
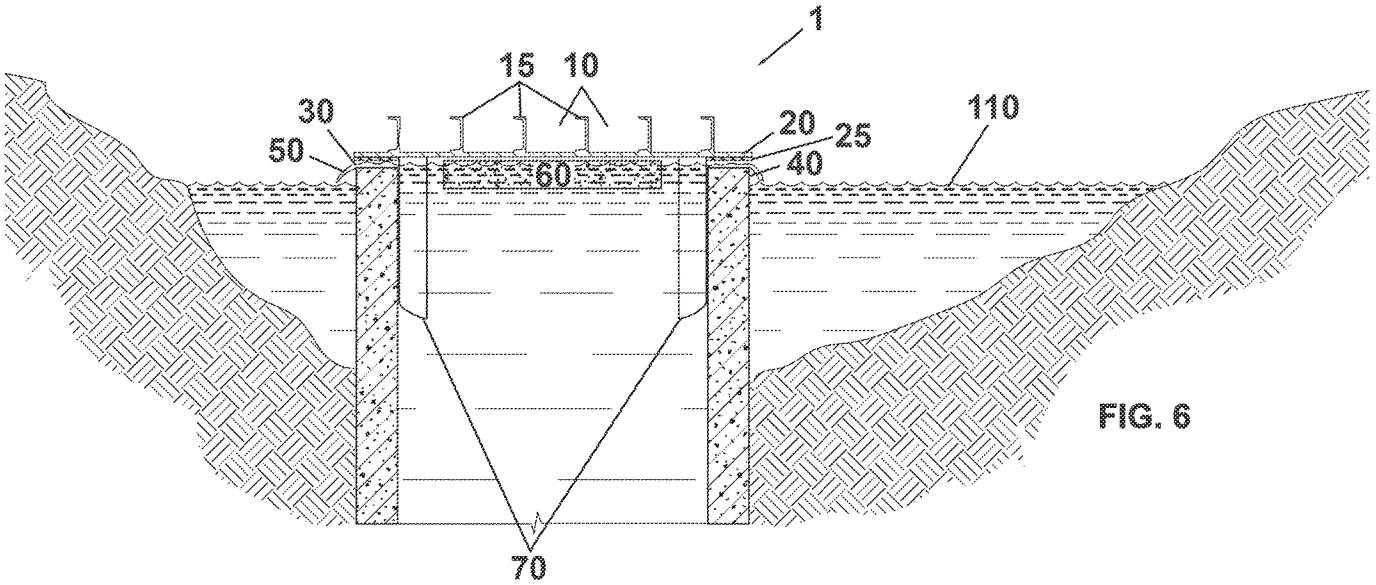
Figure 7:
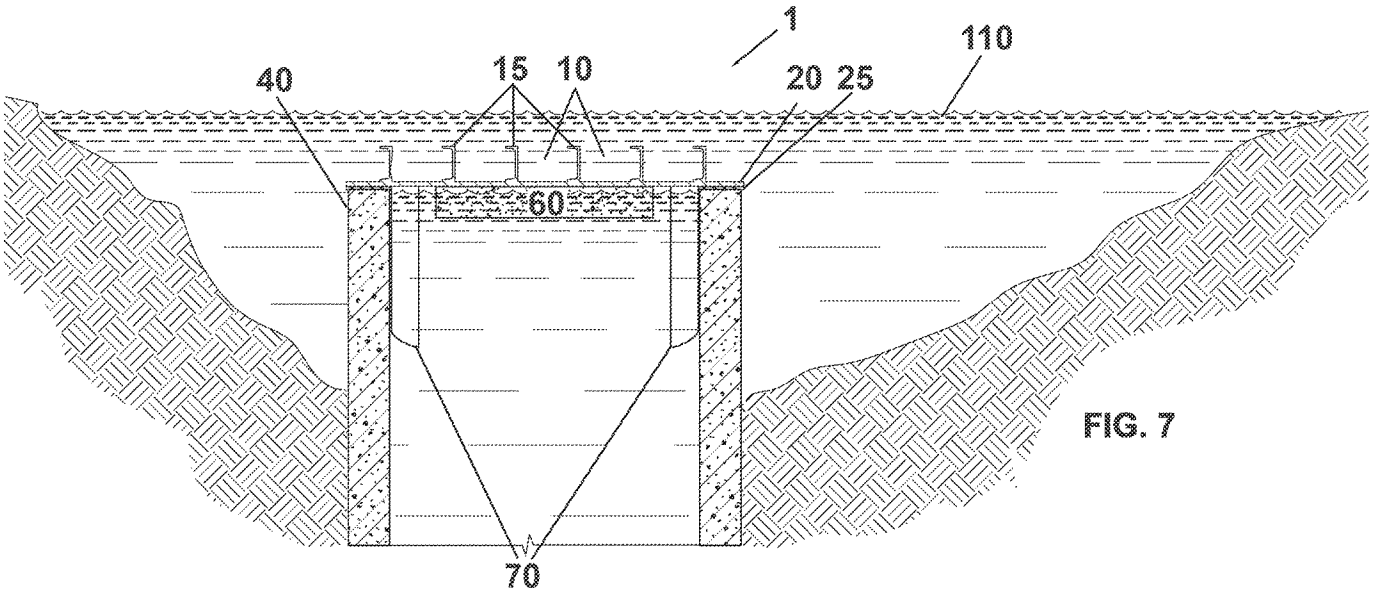

Having thus described the invention in general terms, reference will now be made to the accompanying drawings, which are not necessarily drawn to scale, and wherein:

FIG. 1 is a perspective view of a top portion of a water flow control device in operation, according to an embodiment of the invention;

FIG. 2 is a perspective view of a water flow control device configured for insertion into a conveyance channel apparatus, according to an embodiment of the invention;

FIG. 3 is a side view of a water flow control device, according to an embodiment of the invention;

FIG. 4 is a top view of a water flow control device, according to an embodiment of the invention;

FIG. 5 is a bottom view of a water flow control device, according to an embodiment of the invention;

FIG. 6 is a side view of a water flow control device positioned to control the outflow of water from a basin, according to certain embodiments of the invention; and FIG. 7 is another side view of a water flow control device positioned to prevent the influx of water into a basin, according to other embodiments of the invention.

DETAILED DESCRIPTION OF THE INVENTION

The present invention now will be described more fully hereinafter with reference to the accompanying drawings, in which some, but not all embodiments of the inventions are shown. Preferred embodiments of the invention may be described, but this invention may, however, be embodied in many different forms and should not be construed as limited to the embodiments set forth herein. Rather, these embodiments are provided so that this disclosure will be thorough and complete, and will fully convey the scope of the invention to those skilled in the art. The embodiments of the invention are not to be interpreted in any way as limiting the invention.

As used in the specification and in the appended claims, the singular forms "a", "an", and "the" include plural referents unless the context clearly indicates otherwise. For example, reference to "a channel" may include a plurality of such channels.

It will be understood that relative terms may be used herein to describe one element's relationship to another element as, for example, may be illustrated in the Figures. It will be understood that relative terms are intended to encompass different orientations of the elements in addition to the orientation of elements as illustrated in the exemplary embodiments depicted in the Figures. It will be understood that such terms can be used to describe the relative positions of the element or elements of the invention and are not intended, unless the context clearly indicates otherwise, to be limiting.

Embodiments of the present invention are described herein with reference to various perspectives, including, for example, perspective views that are representations of idealized embodiments of the present invention. As a person having ordinary skill in the art would appreciate, variations from or modifications to the shapes as illustrated in the Figures or the described perspectives are to be expected in practicing the invention. Such variations and/or modifications can be the result of manufacturing techniques, design considerations, and the like, and such variations are intended to be included herein within the scope of the present invention and as further set forth in the claims that follow. The articles of the present invention and their respective components described or illustrated in the Figures are not intended to reflect a precise description or shape of the component of an article and are not intended to limit the scope of the present invention.

Although specific terms are employed herein, they are used in a generic and a descriptive sense only and not for purposes of limitation. All terms, including technical and scientific terms, as used herein, have the same meaning as commonly understood by one of ordinary skill in the art to which this invention belongs unless a term has been otherwise defined. It will be further understood that terms, such as those defined in commonly used dictionaries, should be interpreted as having a meaning as commonly understood by a person having ordinary skill in the art to which this invention belongs. It will be further understood that terms, such as those defined in commonly used dictionaries, should be interpreted as having a meaning that is consistent with their meaning in the context of the relevant art and the present disclosure. Such commonly used terms will not be interpreted in an idealized or overly formal sense unless the disclosure herein expressly so defines otherwise.

As used herein, a "water flow control device" refers to a device that facilitates the removal of water from a basin, a freshwater or a saltwater basin according to certain embodiments of the invention. In one embodiment of the invention, the water flow control device provides, in a non-limiting example, protection against water surges that could otherwise cause unwanted water to be introduced into the basin. According to a non-limiting example, the water surge is the result of a tidal surge that would otherwise allow salt water or freshwater to be introduced into the basin if the water flow control device of the invention was not used to control the water flow rate from the basin.

As used herein, the terms "basin" and/or "system" may be used interchangeably to generally define the area from which either saltwater or freshwater is being removed and also being protected from the introduction of water from the collection or outfall area where the saltwater or freshwater being removed from the basin or system is being introduced. Additionally, the basin or the system may be a freshwater basin or system or a saltwater basin or system.

As used herein, "tideway," "receiving water body," "collection area" and "outfall area" are used interchangeably to mean the location that receives the freshwater or saltwater being removed from the basin and/or system and that contains saltwater or freshwater that is otherwise desired to be prevented from being directed to the basin and/or system.

An aspect of the invention provides a water flow control device defined by a floor, channels configured at the top of the floor for rebalancing and distributing any changes in water flow commonly experienced in the collection area where the water flow control device is positioned and a buoyancy apparatus configured to allow the release of water from a basin or system as long as there is not a threat that water from the collection area can be returned to the basin or system. The water flow control device is coupled with a conveyance channel apparatus that transports water from the basin or system when allowed by the water flow control device. The water flow control device prevents the influx of water back into the basin or system through the conveyance channel apparatus.

The inventor has conceived of a novel and unique design for a water flow control device that allows for the controlled removal of water from a basin but prevents the influx of water into the basin. According to certain embodiment of the invention, the water flow control device controls the outflow of water from a freshwater or a saltwater basin and prevents the influx of saltwater or freshwater into the freshwater or saltwater basin from a collection basin. Preferably, the water flow control device readily allows the outflow of overflow water from a basin while substantially reducing, if not eliminating altogether the amount of water that can be returned to the basin from the collection or outfall area.

FIG. 1 is a perspective view of a top portion of a water flow control device shown in operation, according to an embodiment of the invention. As shown in FIG. 1, a water flow control device 1 comprises a plurality of channels 10 that allows for the redirected movement of water from the water flow control device 1. The channels 10 are interconnected to a floor 20 that provides support for the water flow control device 1 as it may become positioned depending upon the current mode of operation as further explained herein. In its position illustrated in FIG. 1, the water flow control device 1 allows for the movement of water from a basin through an opening 30 that is formed between the floor 20 and a conveyance channel apparatus 40 to allow water 50 to be removed from a basin.

A gasket 25 runs substantially along the entire edge of the bottom portion of the floor 20 to further assist with buoyancy of the water flow control device 1 when water 50 is being removed from the basin, and to allow proper seating of the water flow control device 1 at the conveyance channel apparatus 50 when a backflow of water to the basin needs to be prevented. According to certain embodiments of the invention, one or more guide posts (e.g., 70 in FIG. 2) may include holes at certain levels to allow water into the guide posts (e.g., 70 in FIG. 2) to further assist with controlling buoyancy of the water flow control device 1. In certain embodiments of the invention, the gasket 25 is constructed of a closed cell foam. According to another embodiment of the invention, the gasket 25 comprises a sealing medium.

In certain embodiments of the invention, the sealing medium comprises any one or both of a firm rubber and/or a foam. In certain embodiments of the invention, a buoyant cell is filled with closed cell foam and encapsulated by a high density polyethylene covering. There may be variations of the buoyant cell components, but the important aspects include the volume and absence of a flow obstruction to allow the buoyant cell to possess its desired properties. Without intending to be bound by theory, the volume balances the weight of the device and allows ease of operation when water needs to flow downstream. The balanced buoyant force also enables the positive closure under the reversal of flow from the outfall upstream into the system.

FIG. 2 is a perspective view of a water flow control device configured for insertion into a conveyance channel apparatus, according to an embodiment of the invention. FIG. 2 shows the water flow control device 1 and the conveyance channel apparatus 40 in more detail, and according to this exemplary embodiment of the invention. In addition to the channels 10 and the floor 20 of the water flow control device 1, FIG. 2 shows a flotation device 60 attached at the bottom side of the floor 20. This exemplary water flow control device has four guide posts/support legs 70 to allow the water flow control device 1 to maintain its position and to further allow the water flow control device 1 to remain positioned securely in the conveyance channel apparatus 40. While the exemplary water flow control device 1 of FIG. 2 shows four guide posts 70 that also function as support legs, in this exemplary embodiment of the invention. According to an embodiment of the invention, any plurality of and shape of guide posts and/or support legs may be used to ensure the water flow control device 1 remains positioned securely in the conveyance channel apparatus 40. In certain embodiments of the invention, the guide posts/legs 70 are constructed of an aluminum pipe and cut at 45°. Further pursuant to this embodiment of the invention, preferably, the cut end of the pipe is covered with a welded plate.

In the exemplary embodiment of FIG. 2, a channel 80 is defined by four walls in the conveyance channel apparatus 40. However, this configuration of the conveyance channel apparatus 40 is merely exemplary and any configuration of a conveyance channel apparatus that also includes a channel may be used. Any conveyance channel apparatus known in the art may be used according to other embodiments of the invention. Without intending to be limiting, a conveyance channel apparatus may be any one or any combination of a conduit, watercourse, trench, gutter, trough, furrow, flume, spillway, artery, chamber, tunnel, and the like, whether manmade or natural. Furthermore, any geometric shape of the conveyance channel may be adopted. Of course, adoption of a conveyance channel apparatus in other geometrical configures will require the water flow control device to be appropriately configured to securely fit within the channel conveyance apparatus, but such a water flow control device will still be defined by a plurality of channels, a floor and some form of a buoyancy device to act as the flotation device. As further disclosed herein, these are functional features that are important to the operability of the water flow control device of the invention.

As disclosed herein in more detail, the flotation device 60 acts to elevate the water flow control device 1 to allow the opening 30 to form between the floor 20 and the top support surface 90 of the conveyance channel apparatus 40 as shown in FIGS. 1 & 2. This opening 30 allows water 50 that is carried through the channel 80 from a basin to be emptied into a tideway, river, marsh, wetland or other water body, as non-limiting examples, that is intended to receive the discharged water. However, the discharged water becomes mixed with the other water within the tideway, and it is undesirable to allow this water to be returned to the basin. A non-limiting example of this type of arrangement is when the basin contains freshwater and excess freshwater collected in the basin is to be directed to a saltwater tideway.

In the event the level of the tideway begins to rise above the opening 30 that exists between the floor 20, namely the gasket 25 in certain embodiments of the invention, of the water flow control device 1 and a top surface 90 of the conveyance channel apparatus 40 also known herein as an engagement surface, that otherwise prevents water from the tideway to be redirected to the basin. The water flow control device 1 of the invention is configured such that an increase in level of the tideway causes the buoyancy effect of the flotation device 60 to be overcome and the floor 20 of the water flow control device 1 will lower until the gasket 25 meets the top surface 90 of the conveyance channel apparatus 40 in effect closing off substantially entirely the opening 30 that previously existed to allow water 50 to be removed from the basin. Thus, the water flow control device 1 becomes positioned to prevent the inflow of water into the channel 80, substantially reducing its possibility for entry into the basin.

FIG. 3 is a side view of a water flow control device, according to an embodiment of the invention. The channels 10 are formed by channel walls 15 that are affixed to the top 20 of the water flow control device 1. Further pursuant to this embodiment of the invention and as also depicted in FIG. 1, the channel walls 15 include a bottom side extension 17 and a top side extension 19. Without intending to be limiting, the bottom side extension 17 and the top side extension 19, serve multiple uses including better directing and maintaining the direction of flow through the channels 10, reducing turbulent flow that otherwise may develop in the channels 10, and preventing spillover of water within one channel to another channel, which otherwise may result in an imbalance of water of the water flow control device 1. The bottom side extension 17, additionally, again without intending to be limiting, allows the channels 10 to become more securely affixed to the floor 20.

In the exemplary embodiment of FIG. 3, the buoyancy device includes a flotation device 60 having a plurality of interstitial spaces 65 and a gasket 25 configured to assist with proper buoyancy of the water flow control device 1. In certain embodiments of the invention, the flotation device 60 is a closed cell flotation device 60. FIG. 3 also shows the water flow control device 1 may also include a hoist point 100 to allow the water flow control device 1 to be more easily positioned into the conveyance channel apparatus 40. Without intending to be limiting, the hoist point 100 allows the water flow control device 1 to be more easily positioned into the channel 80 upon initial installation of the water flow control device 1, and when the water flow control device 1 needs to be adjusted or removed in a repair and/or maintenance procedure being performed on the system.

FIG. 4 is a top view of a water flow control device, according to an embodiment of the invention. FIG. 4 shows the placement of the channels 10, channel walls 15 and hoist points 100 at the floor 20 of the water flow control device 1, according to this exemplary embodiment of the invention.

FIG. 5 is a bottom view of a water flow control device, according to an embodiment of the invention. FIG. 5 shows the floor 20 and the gasket 25 disposed substantially circumferentially about the perimeter of the floor 20, which assists with the buoyancy of the water flow control device 1. The flotation device 60 having a plurality of interstitial spaces 65 also assisting with buoyancy is also shown. The position of the guide posts/legs 70 are also shown in this exemplary bottom view of the water flow control device 1. As further illustrated in FIG. 5, in certain embodiments of the invention, it is preferred that the guide posts 70 that also function as legs according to this exemplary embodiment of the invention are substantially flush with the gasket 25.

FIG. 6 is a side view of a water flow control device positioned to control the outflow of water from a basin, according to certain embodiments of the invention. The water flow control device 1 and conveyance channel apparatus 40 has been installed in tideway 110. When the tideway 110 is at a level that it can receive the discharged water, the buoyancy with the water flow control device 1 allows water 50 to be discharged through the opening 30 that exists between the floor 20 and the top surface 90 of the conveyance channel apparatus 40.

Conversely, FIG. 7 is another side view of a water flow control device positioned to prevent the influx of water into a basin, according to certain embodiments of the invention. When the level in the tideway 110 is such that it would influx water into an opening, the buoyancy apparatus of the water flow control device 1 is overcome and the gasket 25 of the floor 20 becomes seated at the top surface 90 of the conveyance channel apparatus 40 to prevent the influx of water back into the channel 80. Thus, the water flow control device 1 prevents any increases in level of the tideway 110 that may be caused by tidal surges, for example, to return water back to the basin.

In an embodiment of the invention, the water flow control device 1 that is installed in the tideway 110 further includes a cover (not illustrated) that sits atop of the floor 20 and further held in place by the tops of the channel walls 15 acting to cover the channels 10 to prevent debris from collecting in the channels.

Another aspect of the invention provides a method for controlling the outflow of water from a basin while preventing an influx of water to the basin. The method of controlling the outflow of water from a basin comprises providing a water flow control device having a floor, a buoyancy apparatus and a conveyance channel apparatus, sensing when water may safely be removed through the conveyance channel apparatus, creating an opening to allow the removal of water through the conveyance channel apparatus, sensing when water may not safely be removed through the conveyance channel apparatus, and closing the opening to prevent the influx of water into the conveyance channel apparatus.

In an embodiment of the invention, the buoyancy apparatus is configured to sense when water may safely be removed through the conveyance channel apparatus depending upon the level of the of the tideway where the water flow control is located. In certain embodiments of the invention, when the level is such that water may be evacuated from the conveyance channel apparatus, the buoyancy apparatus causes an opening to be formed between the floor of the water flow control device and a top surface of the conveyance channel apparatus allowing water to leave from a channel of the conveyance channel apparatus.

In certain other embodiments of the invention, the buoyancy apparatus is configured to sense when the level of the tideway would cause an influx of water into an otherwise formed opening. Further pursuant to this embodiment of the invention, the buoyancy apparatus causes any formed opening to close to prevent the influx of water through the water flow control device. In an embodiment of the invention, the opening closes by ensuring a gasket that substantially surrounds the perimeter of a bottom surface of the floor to contact a top surface of the conveyance channel apparatus.

Many modifications and other embodiments of the invention set forth herein will come to mind to one skilled in the art to which this invention pertains having the benefit of the teachings presented in the descriptions herein. It will be appreciated by those skilled in the art that changes could be made to the embodiments described herein without departing from the broad inventive concept thereof. Therefore, it is understood that this invention is not limited to the particular embodiments disclosed, but it is intended to cover modifications within the spirit and scope of the present invention as defined by the included claims.

That which is claimed:

1. A water flow control device comprising
a floor;
a plurality of channels at a top of the floor;
a buoyancy apparatus that determines an open or a closed position of the water flow control device; and
a conveyance channel apparatus through which water may be removed based on the position of the water flow control device.

2. The water flow control device of claim 1, wherein the buoyancy apparatus comprising a flotation device affixed to a bottom of the floor.

3. The water flow control device of claim 2, wherein the flotation device having a multiplicity of interstitial spaces to control the functionality of the buoyancy apparatus.

4. The water flow control device of claim 1, the water flow control device additionally comprising a gasket substantially configured about a circumferential perimeter of a bottom of the floor.

5. The water flow control device of claim 4, wherein the gasket comprises a sealing medium between the circumferential perimeter of the bottom of the floor and an engagement surface of the conveyance channel apparatus.

6. The water flow control device of claim 5, wherein the sealing medium comprises at least one of a firm rubber and a foam.

7. The water flow control device of claim 5, wherein the sealing medium having at least one of a medium density rubber and a medium density foam.

8. The water flow control device of claim 7, wherein the buoyancy apparatus comprises a buoyant cell and a polymer sheath, the polymer sheath substantially encloses the buoyant cell.

9. The water flow control device of claim 8, where the polymer sheath comprises a high density polyethylene (HDPE).

10. The water flow control device of claim 4, wherein a water flow control device comprising one or more guide posts that are substantially flush with an inside edge of the gasket.

11. The water flow control device of claim 4, wherein the conveyance channel apparatus comprises a top surface upon which the gasket becomes engaged to close off an opening between the water flow control device and the conveyance channel apparatus.

12. The water flow control device of claim 11, wherein the conveyance channel apparatus having four sides and a geometric shape that is substantially square.

13. The water flow control device of claim 12, the conveyance channel apparatus is substantially constructed of a concrete.

14. The water flow control device of claim 1, wherein the buoyancy apparatus forms an opening to allow the removal of water through a channel of the conveyance channel apparatus.

15. The water flow control device of claim 14, wherein the buoyancy apparatus closes the opening to prevent the influx of water into the channel of the conveyance channel apparatus.

16. The water flow control device of claim 1, the water flow control device further comprising one or more guide posts to assist with a position of the water flow control device in the conveyance channel apparatus.

17. A method for controlling the outflow of water from a basin and preventing an influx of water to the basin:
providing a water flow control device having a buoyancy apparatus and a conveyance channel apparatus;
sensing through the use of the buoyancy apparatus when water may safely be removed through the conveyance channel apparatus;
creating an opening using the buoyancy apparatus to allow the removal of water through the conveyance channel apparatus;
sensing through the use of the buoyancy apparatus when water may not safely be removed through the conveyance channel apparatus; and
closing the opening using the buoyancy apparatus to prevent the influx of water into the conveyance channel apparatus.

18. The method of claim 17, wherein the buoyancy apparatus allows an opening to be formed between a floor of the water flow control device and a top surface of the conveyance channel apparatus.

19. The method of claim 18, wherein a gasket substantially surrounds a bottom perimeter of the floor.

20. The method of claim 19, wherein the buoyancy apparatus allows the gasket to contact the top surface of the conveyance channel apparatus to close the opening that had been formed.

* * * * *